US007009578B2

(12) United States Patent
Nolan et al.

(10) Patent No.: US 7,009,578 B2
(45) Date of Patent: Mar. 7, 2006

(54) DEPLOYABLE ANTENNA WITH FOLDABLE RESILIENT MEMBERS

(75) Inventors: Michael Nolan, Hermosa Beach, CA (US); Samir F. Bassily, Los Angeles, CA (US); Richard W. Gehle, Yorba Linda, CA (US); Jerry Miles Lake, Torrance, CA (US)

(73) Assignee: The Boeing Company, Chicago, IL (US)

( * ) Notice: Subject to any disclaimer, the term of this patent is extended or adjusted under 35 U.S.C. 154(b) by 149 days.

(21) Appl. No.: 10/707,032

(22) Filed: Nov. 17, 2003

(65) Prior Publication Data

US 2005/0104798 A1 May 19, 2005

(51) Int. Cl.
*H01Q 15/20* (2006.01)

(52) U.S. Cl. ..... 343/915; 343/897

(58) Field of Classification Search ..... 343/897, 343/912, 915, 916

See application file for complete search history.

(56) References Cited

U.S. PATENT DOCUMENTS 3,360,798 A * 12/1967 Webb ..... 343/915
3,521,290 A * 7/1970 Bahiman et al. ..... 343/915
4,498,087 A * 2/1985 Imbiel et al. ..... 343/915
5,680,145 A 10/1997 Thomson et al. ..... 343/915
6,104,358 A * 8/2000 Parker et al. ..... 343/915
6,321,503 B1 11/2001 Warren ..... 52/420

* cited by examiner

*Primary Examiner*—Tho Phan
(74) *Attorney, Agent, or Firm*—Artz & Artz, PC

(57) ABSTRACT

A framework for a deployable antenna is disclosed herein. The framework basically includes a plurality of elongate ribs, a matching plurality of foldable resilient members, and a hub. Each of the elongate ribs has both a proximal end and a distal end. The foldable resilient members serve to interconnect the proximal ends of the elongate ribs to the hub. Within such a configuration, each of the foldable resilient members is capable of storing strain energy whenever forcibly folded and also releasing the strain energy whenever subsequently permitted to elastically unfold. Thus, whenever the elongate ribs are released from a stowed position in which the foldable resilient members are forcibly folded, the strain energy causes automatic deployment of the antenna as the foldable resilient members are permitted to elastically unfold. In sum, therefore, the framework obviates many conventional uses of electro-mechanical motors or actuators in deploying various antennas.

20 Claims, 7 Drawing Sheets

DEPLOYABLE ANTENNA WITH FOLDABLE RESILIENT MEMBERS

BACKGROUND OF INVENTION

The present invention generally relates to antennas that are mounted and employed onboard, for example, spacecraft or satellites. The present invention more particularly relates to frameworks or systems for deploying such onboard antennas while the spacecraft or satellites are in outer space.

Reflector antennas are commonly mounted and employed onboard spacecraft for sending and receiving electromagnetic waves within the radio frequency (RF) spectrum for communicative purposes while the spacecraft are in outer space. Although different types of reflector antennas may be utilized for such purposes, a commonly used antenna is a rib-supported reflector antenna. In a rib-supported reflector antenna, a framework or system of ribs is utilized to suspend, shape, and position a flexible mesh or screen made of RF energy reflective material. One significant advantage in utilizing such a rib-supported reflector antenna is that large-aperture antennas with sizeable diameters of up to 10 meters and more may therewith be implemented.

To successfully employ such a sizeable rib-supported reflector antenna onboard a spacecraft in outer space, the antenna must first generally be stowed in a folded, collapsed, or other reduced-volume configuration so that the antenna fits within the overall launch envelope of the spacecraft upon takeoff and initial transit into outer space. Once the spacecraft reaches outer space or its intended orbit, the rib-supported reflector antenna may then be unfolded, expanded, or spread out to thereby deploy the antenna into full volume for operation and service.

To successfully deploy a rib-supported reflector antenna in such a manner, its associated framework or system of ribs is typically unfolded, distended, or erected via a means that is, according to convention, largely electromechanical in nature. For example, in one known antenna deployment system, one or more electro-mechanical motors or actuators with associated drive cables are utilized to drive the unfolding, distension, and erection of a framework or system of ribs for a rib-supported reflector antenna. Also, in this same known system, the framework or system of ribs itself includes numerous metallic hinges and/or sliding joints that interconnect the ribs together to thereby further facilitate overall antenna deployment.

Although such a conventional electro-mechanical system can be effective in successfully deploying a rib-supported reflector antenna, the mechanisms can be heavy and also complex to use and operate. In particular, such a system with motors, actuators, pulleys, cables, hinges, sliding joints, and the like can be somewhat massive both in terms of weight and size. Any such excess weight or size is generally undesirable onboard a spacecraft, for it generally necessitates an accommodating increase in launch thrust or launch envelope size. In addition, such a system can also be complex in terms of both the positioning and the cooperative functioning of its many interrelated parts, thereby giving rise to potential reliability concerns and increases in expenses for components.

In light of the above, there is a present need in the art for an improved framework or system that is lighter in weight, less expensive, and less complex than known deployable antenna systems. In addition, there is also a present need for a system that can successfully deploy a rib-supported reflector antenna in outer space with minimal to no assistance required from, for example, electromechanical motors or actuators.

SUMMARY OF INVENTION

The present invention provides a framework for a deployable antenna. The framework basically includes a plurality of elongate ribs, a matching plurality of foldable resilient members, and a hub. Each of the elongate ribs has both a proximal end and a distal end. The foldable resilient members, in turn, serve to interconnect the proximal ends of the elongate ribs to the hub. The hub itself is structurally adapted for being mounted on, for example, a space travel vehicle such as an orbiter, a satellite, a spacecraft, a space probe, a spaceship, a space shuttle, a space station, or the like.

Within such a configuration, each of the foldable resilient members is capable of storing strain energy whenever forcibly folded and also releasing the strain energy whenever subsequently permitted to elastically unfold. Thus, whenever the elongate ribs are released from a stowed position in which the foldable resilient members are forcibly folded, the strain energy causes automatic deployment of the antenna as the foldable resilient members are permitted to elastically unfold.

In general, the framework of the present invention successfully renders unnecessary many conventional uses of electro-mechanical motors or actuators in deploying various antennas. Furthermore, it is believed that other favorable aspects and advantages of the present invention will become apparent to those skilled in the art upon reading the following detailed description and appended claims and also upon referring to the accompanying drawing figures.

BRIEF DESCRIPTION OF DRAWINGS

The present invention will be described, by way of example, with reference to the following drawing figures. Also, in the following drawing figures, the same or similar reference numerals will be used to identify the same or similar components or features.

DETAILED DESCRIPTION

Figure 1:
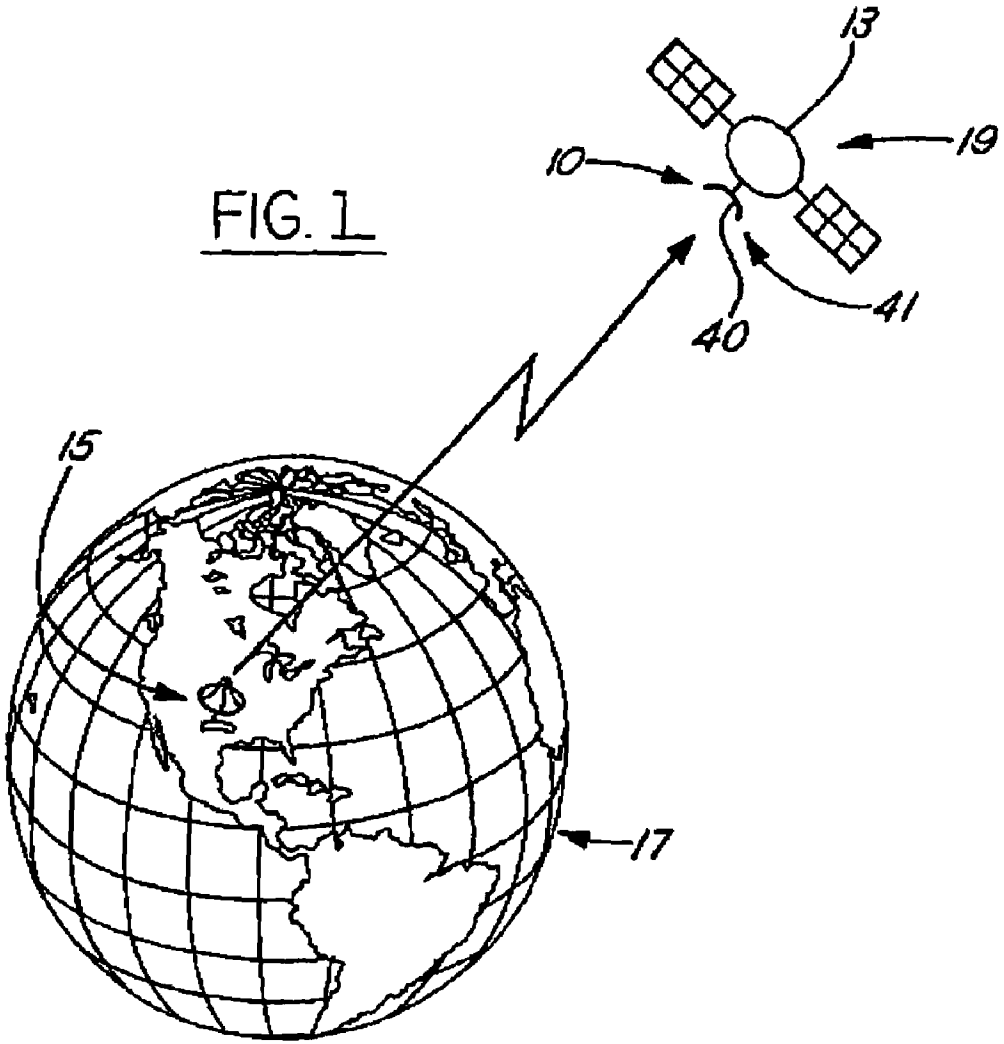
FIG. 1 is a perspective view of a satellite in orbit about the earth. In this view, the satellite is shown to have a deployable antenna that includes both a framework and a reflective mesh.

In FIG. 1, a perspective view of a satellite 19 in orbit about the earth 17 is illustrated. The satellite 19 itself includes both a fuselage or body 13 and a deployable mesh reflector type antenna 41 mounted thereon. The deployable antenna 41, in turn, includes both a reflective mesh 40 and a supportive framework 10 for deploying and suspending the mesh 40. In having the deployable antenna 41 onboard, the satellite 19 is able to send and receive electromagnetic waves for thereby communicating with, for example, a ground communications station 15 while the satellite 19 is in orbit in outer space.

Figure 2:
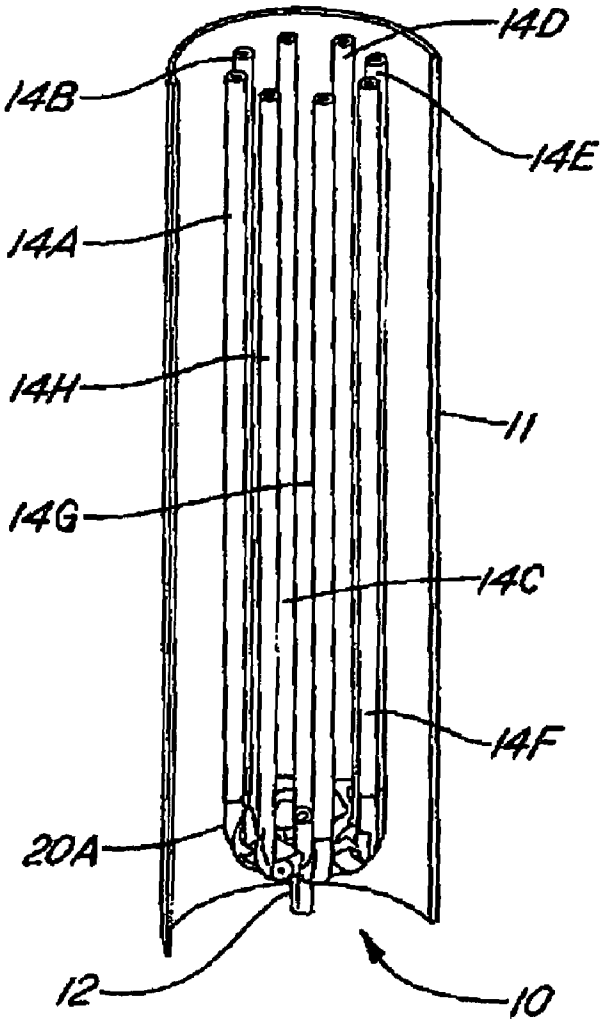
FIG. 2 is a perspective view of a framework for a deployable antenna. In this view, the framework is shown to primarily include a hub, a plurality of elongate ribs each having a proximal end and a distal end, and a matching plurality of foldable resilient members interconnecting the proximal ends of the elongate ribs to the hub. Also, in this view, the elongate ribs are particularly shown in a captured position for stowage.
Figure 3:
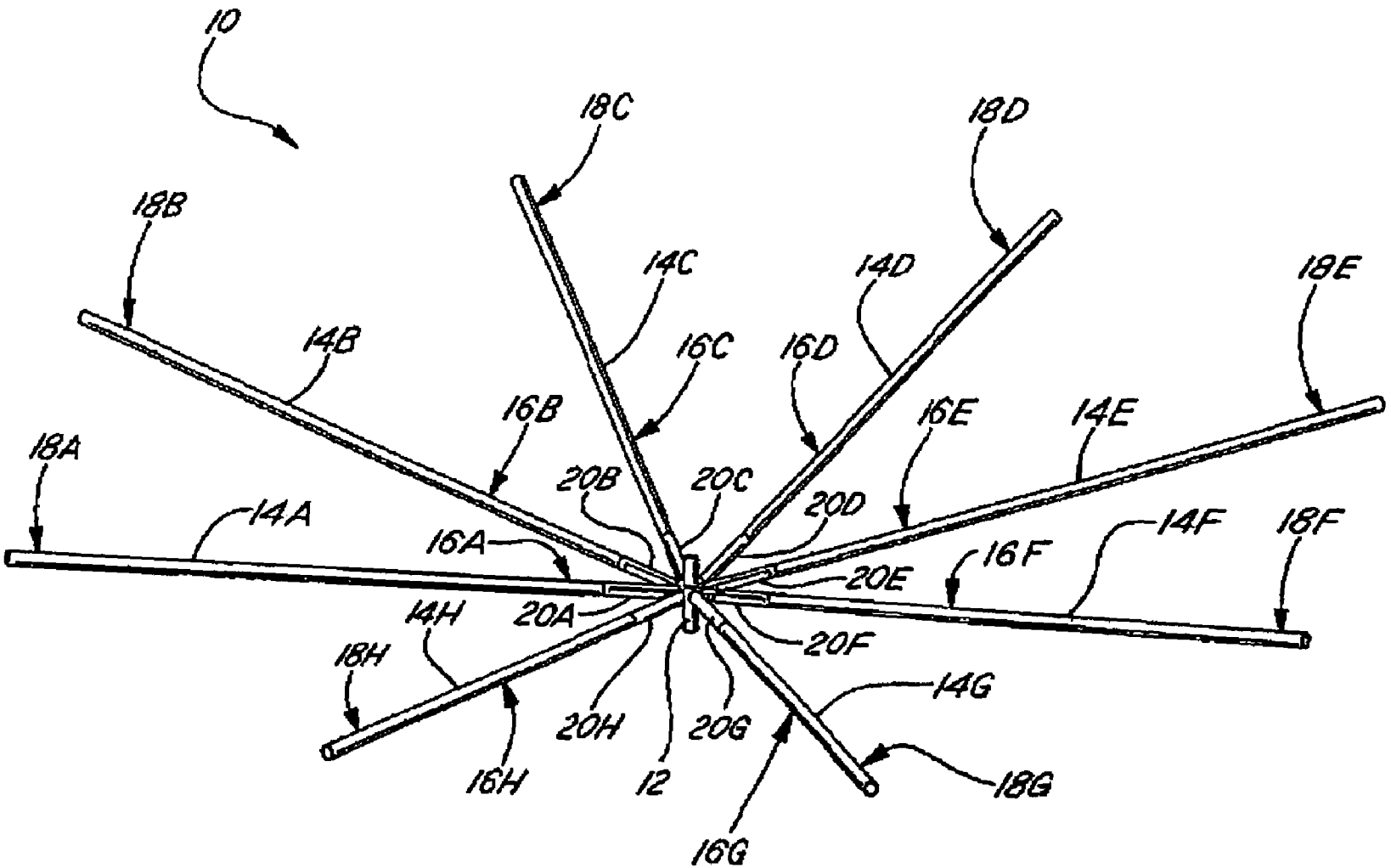
FIG. 3 is a perspective view of the framework in FIG. 2. In this view, the elongate ribs are alternatively shown deployed in a released position.

In FIGS. 2 and 3, perspective views of the framework 10 for the deployable mesh reflector type antenna 41 are illustrated therein. As illustrated, the framework 10 basically includes a hub 12, a plurality of elongate ribs 14, and a matching plurality of foldable resilient members 20. In the particular embodiment of the framework 10 illustrated in FIGS. 2 and 3, the plurality of elongate ribs 14 includes individual elongate ribs 14A through 14H, and the matching plurality of foldable resilient members 20 includes individual resilient members 20A through 20H.

The hub 12, first of all, is structurally adapted for being mounted on, for example, a space travel vehicle such as an orbiter, a satellite (as in FIG. 1), a spacecraft, a space probe, a spaceship, a space shuttle, or a space station. Although other constituent materials may be utilized, the hub 12 itself is preferably made of either metal or nonmetallic fibers embedded within a resin matrix. In the latter case, the non-metallic fibers preferably comprise carbon in its allotropic form of graphite, and the resin matrix preferably includes an epoxy, cyanate esther, or thermoplastic resin.

The elongate ribs 14, next of all, are generally tubular in form with each having a substantially circular cross-section. Each elongate rib 14 has both a proximal end 16 and a distal end 18. Although other constituent materials may be utilized, each elongate rib 14 is preferably made of non-metallic fibers embedded within a resin matrix. The non-metallic fibers preferably comprise carbon in its allotropic form of graphite, and the resin matrix preferably includes an epoxy, cyanate esther, or thermoplastic resin. Given such a material composition, each elongate rib 14 therefore has an inherently low coefficient of thermal expansion (CTE) of generally less than $1\times10^{-6}/°$ F. Such a low CTE, in general, is highly preferred and deemed ideal for space based applications.

The foldable resilient members 20, last of all, serve to interconnect the proximal ends 16 of the elongate ribs 14 to the hub 12. In general, each foldable resilient member 20 has a shape substantially resembling a hollow tube segment. Although other constituent materials may be utilized, each foldable resilient member 20 is preferably made of non-metallic fibers embedded within a resin matrix. The non-metallic fibers preferably comprise carbon in its allotropic form of graphite, and the resin matrix preferably includes an epoxy, cyanate esther, or thermoplastic resin. Given such a material composition, each foldable resilient member 20 therefore has an inherently low coefficient of thermal expansion (CTE) of generally less than $1\times10^{-6}/°$ F. Also, given such a material composition, each foldable resilient member 20 may therefore be utilized within the framework 10 as being, in essence, a "high strain energy storage device" (HSESD). As such, each foldable resilient member 20 is capable of storing strain energy whenever forcibly folded and also releasing the strain energy whenever subsequently permitted to elastically unfold. Thus, each time that a foldable resilient member 20 is freely permitted to fully elastically unfold, the foldable resilient member 20 is generally able to return back to its same original unfolded form, shape, and position.

In FIG. 2. the framework 10 Is shown to further include a removable restraint and stowage system 11. In this view, the removable restraint collectively holds the elongate ribs 14 in a captured position. In such a captured position, the foldable resilient members 20 are forcibly folded such that the distal ends 18 of the elongate ribs 14 are thereby proximately situated together. With the distal ends 18 of the elongate ribs 14 proximately situated in this manner, the elongate ribs 14 are thereby collectively arranged in a substantially parallel fashion with each other. In this way, the elongate ribs 14 are thereby made stowable in a small and substantially cylindrical volume. In general, the elongate ribs 14 are held and stowed in this position onboard a spacecraft during both takeoff and initial transit into outer space. Once the spacecraft reaches its intended orbit in outer space, the removable restraint and stowage system 11. is then removed so that both the foldable resilient members 20 and the elongate ribs 14 of the framework 10 are released from their captured position and thereby deployed.

In FIG. 3, the removable restraint and stowage system 11 of FIG. 2 has been removed so that both the foldable resilient members 20 and the elongate ribs 14 are thereby deployed into a released position. In general, whenever the removable restraint is fully removed from the elongate ribs 14, the strain energy stored in the foldable resilient members 20 while forcibly folded is then suddenly released, thereby driving and causing automatic and immediate deployment of the framework 10 by forcibly unfolding the foldable resilient members 20 in an elastic manner such that the elongate ribs 14 are thereby splayed apart into a released position. As illustrated in FIG. 3, the elongate ribs 14 longitudinally radiate from the hub 12 in a substantially circumferential manner when deployed into such a released position.

Figure 4A:
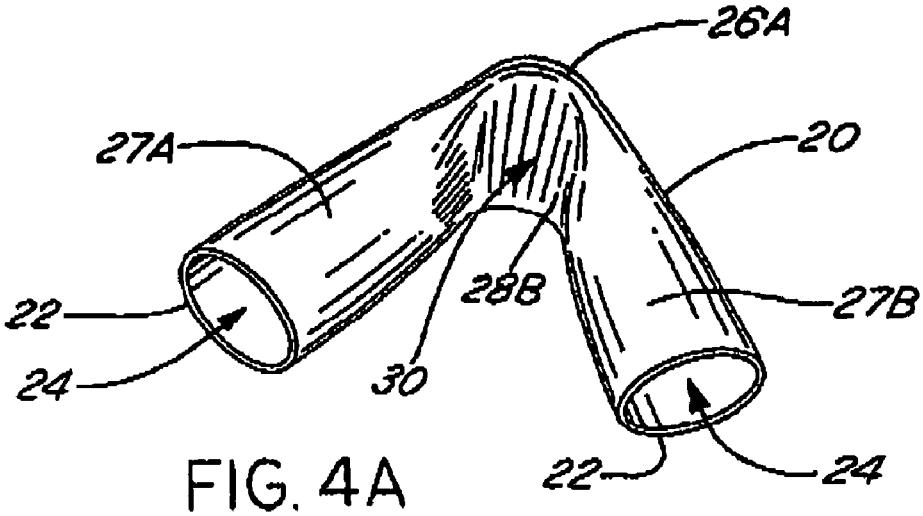
FIG. 4A is a perspective view of a foldable resilient member. In this view, the foldable resilient member is forcibly folded for stowage.
Figure 4B:
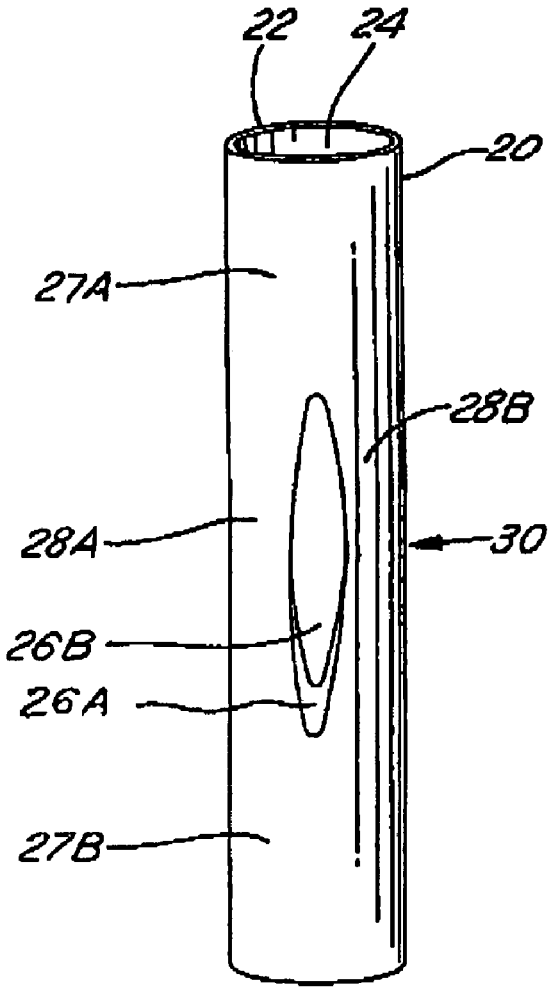
FIG. 4B is a perspective view of the foldable resilient member in FIG. 4A. In this view, the foldable resilient member is alternatively shown in a released and elastically unfolded position for deployment. Also, in this view, the foldable resilient member is shown to have a cylindrical wall with elongated slots defined therethrough.
Figure 4C:
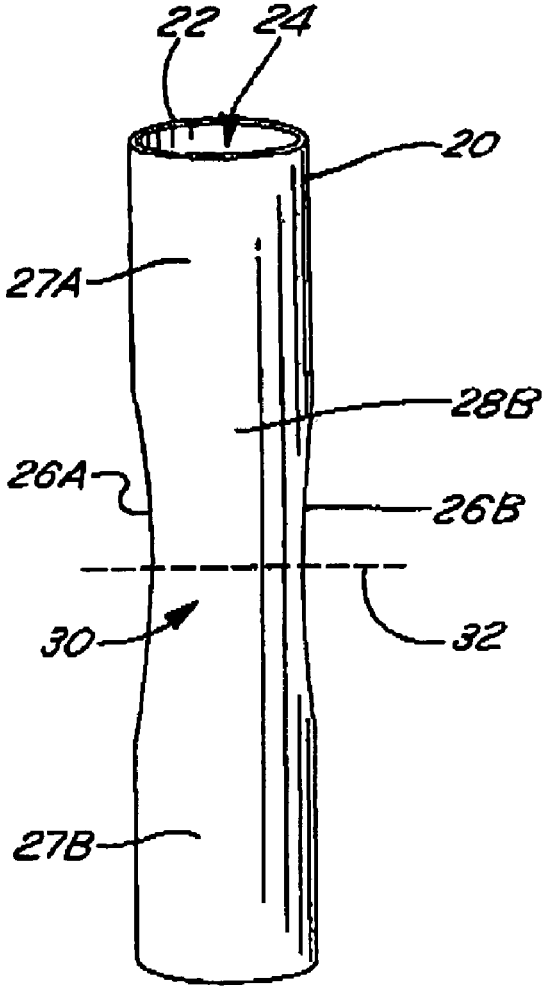
FIG. 4C is an alternative perspective view of the foldable resilient member in FIG. 4B. In this alternative view, the foldable resilient member has been rotated 90 degrees from its position in FIG. 4B.

In FIGS. 4A, 4B, and 4C, perspective views of a generic embodiment of a foldable resilient member 20 are illustrated therein. As generally illustrated, the foldable resilient member 20 is substantially monolithic in form and has an overall shape that substantially resembles a hollow tube segment. Given such form and shape, the foldable resilient member 20 thus has a cylindrical wall 22 that generally encircles a hollow 24 defined therewithin. A foldable hinge area 30 integral with the cylindrical wall 22 is defined along the length of the foldable resilient member 20 with the help of two elongated slots 26A and 26B defined through the same cylindrical wall 22. As particularly illustrated in FIGS. 4B and 4C, the two elongated slots 26A and 26B generally oppose each such that two longitudinal strips 28A and 28B of the cylindrical wall 22 are thereby defined and separated by the two elongated slots 26A and 26B. Within such a configuration, the two longitudinal strips 28A and 28B fold as particularly shown in FIG. 4A when subjected to localized buckling forces. In this manner, the foldable resilient member 20 is able to precisely fold within the hinge area 30 about a folding axis 32 (see FIG. 4C) defined between two cylindrical end portions 27A and 27B of the foldable resilient member 20. Because the foldable resilient member 20 is monolithically formed from a substantially continuous material, the foldable resilient member 20 is therefore dimensionally stable, sufficiently strong, and therefore resistant to unintended buckling, torsion, and shear.

At this point, however, it is to be understood that the term "slots", as used herein, is to mean any openings, slits, and/or cuts of generally any configuration. Also, though the two elongated slots 26A and 26B defined through the cylindrical wall 22 of the foldable resilient member 20 in FIGS. 4B and 4C are particularly shown to be diametrically opposing each other, such positioning is not necessary according to the present invention. Instead, all that is required pursuant to the present invention is that one or more slots be defined within the cylindrical wall of a foldable resilient member such that the one or more slots are generally circumferentially spaced apart within the cylindrical wall in a generally opposing configuration. Within such a configuration, a given slot need not necessarily diametrically oppose another slot, even if there are only two slots defined through the cylindrical wall. Moreover, although the elongated slots 26A and 26B in FIGS. 4B and 4C are each shown to be of the same length and opening width, such is not necessary according to the present invention. Instead, both the length and opening width of slots defined within a cylindrical wall at or near a hinge area may be different depending on specific design and operational goals for a particular foldable resilient member. Furthermore, the general overall sizes of slots may vary from a mere slit to a wide elongated opening. Lastly, slots defined through a cylindrical wall need not necessarily be in the shape of elongated ovals pursuant to the present invention. Instead, slots may alternatively be shaped, for example, like rectangles, triangles, or even diamonds with generally rounded corners.

For any potential non-space related applications, a foldable resilient member may, for example, be made of plastic material (such as polycarbonate), polyurethane, Delrin™, nylon, or even metal. For space based applications in particular, however, each foldable resilient member 20, as briefly alluded to hereinabove, is preferably made of a composite material such as, for example, non-metallic fibers embedded within a resin matrix. Such non-metallic fibers preferably comprise carbon in its allotropic form of graphite, and the resin matrix preferably includes an epoxy, cyanate esther, or thermoplastic resin. In one particular embodiment, the graphite fibers may be braided using a round braider to thereby form a triaxial braid in the shape of a tube which may then be impregnated with a polycarbonate resin. Then, a thin wall aluminum tube may be wrapped in Teflon™ and thereafter with a sheet of Lexan™ material. Once wrapped in this manner, a triaxial graphite braid may then be formed over the Lexan™ sheet, and additional layers of Lexan™ may then be added over the triaxial graphite braid. After being assembled in this manner, both pressure and an elevated temperature may then be applied to thereby consolidate the Lexan™ material with the graphite fibers. Once properly consolidated, slots may then be cut into the wall of the resultant tubular member in a desired configuration to thereby complete construction of a foldable resilient member. Given such a construction, the resultant foldable resilient member will therefore have an inherently low coefficient of thermal expansion (CTE) of generally less than $1\times10^{-6}/°$ F., which is particularly desirable for space based applications. Furthermore, by carefully predetermining the constituent material(s) to be included within a foldable resilient member, the resultant coefficient of thermal expansion (CTE) and/or conductivity of the foldable resilient member can thereby be precisely tailored to meet various different design goals and performance requirements.

Such a foldable resilient member 20 has been developed by Foster Miller Incorporated of Waltham, Mass. and patented in U.S. Pat. No. 6,321,503, incorporated herein by reference, under the title "Foldable Member" on Nov. 27, 2001. However, a foldable resilient member 20 pursuant to the present invention may be variously shaped and made of any known constituent material that generally enables the foldable resilient member 20 to (1) endure high induced strain during stowage without being significantly damaged or permanently deformed, (2) release a significant amount of strain energy when released from a forcibly folded position, (3) return back to its same original unfolded form, shape, and position whenever freely permitted to fully elastically unfold, (4) have a low overall CTE, and (5) have sufficient stiffness for being able to precisely hold the elongate ribs 14 in a fixed position whenever deployed into a released position.

Figure 5:
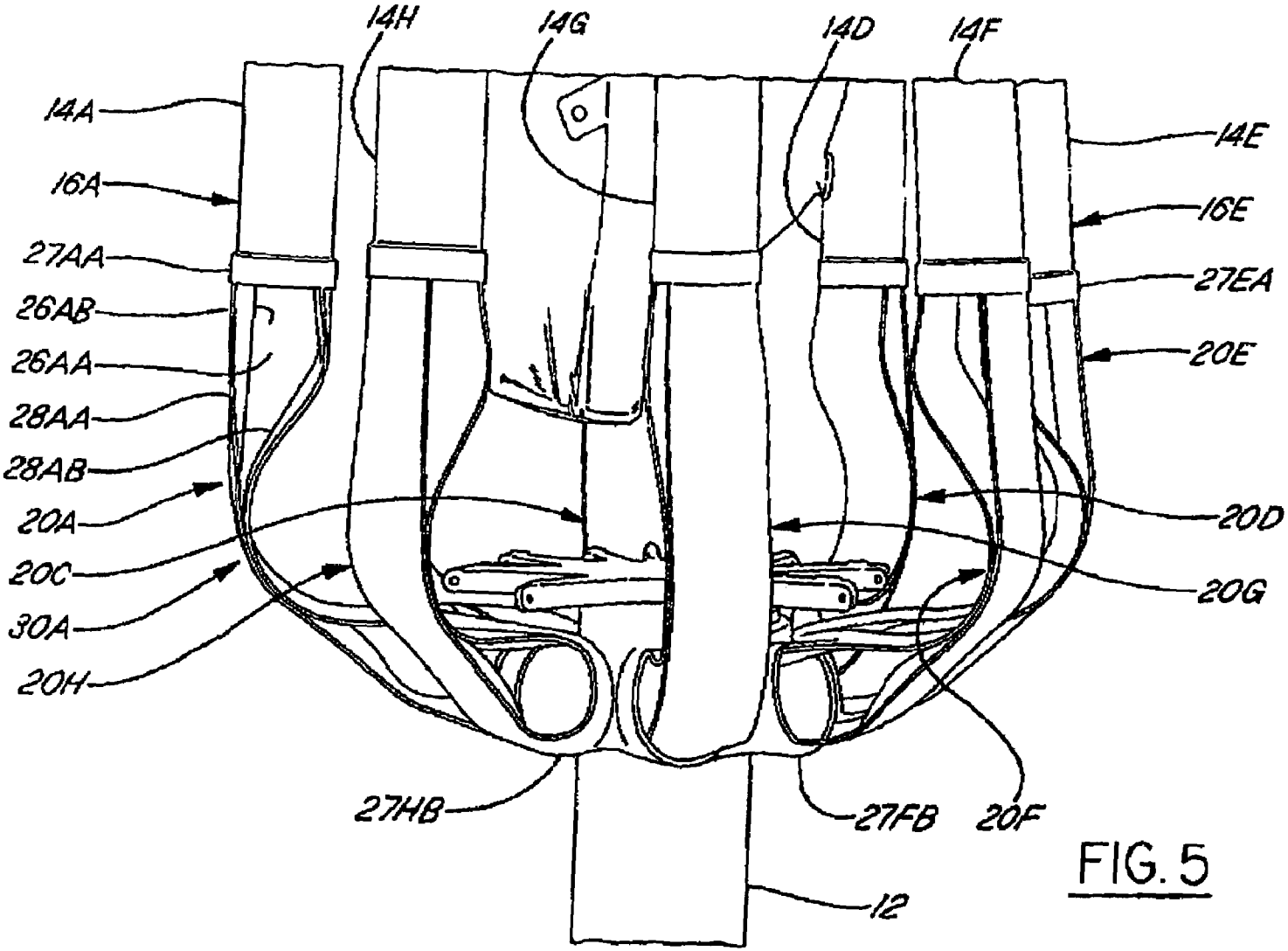
FIG. 5 is a close-up, perspective view of the foldable resilient members in FIG. 2. In this view, the foldable resilient members are forcibly folded for stowage.

In FIG. 5, a close-up, perspective view of the foldable resilient members 20 in FIG. 2 is shown wherein the foldable resilient members 20 are all forcibly folded for stowage. In the particular embodiment shown in FIG. 5, the foldable resilient member 20A, for example, includes two longitudinal strips 28AA and 28AB that are circumferentially separated by two elongated slots 26AA and 26AB. Each of the two longitudinal strips 28AA and 28AB preferably includes three or four bonded layers of non-metallic fibers embedded within a resin matrix. The non-metallic fibers preferably comprise carbon in its allotropic form of graphite, and the resin matrix preferably includes an epoxy, cyanate esther, or thermoplastic resin. The two longitudinal strips 28AA and 28AB are both fastened between two short cylindrical end portions 27AA and 27AB (hidden) such that the foldable resilient member 20A has an overall shape that substantially resembles a hollow tube segment when the foldable resilient member 20A is freely permitted to fully elastically unfold. The two elongated slots 26AA and 26AB, in turn, are substantially rectangular in shape whenever the foldable resilient member 20A is freely permitted to fully elastically unfold. In this particular embodiment, the non-monolithic form of the foldable resilient member 20A in conjunction with the multi-layer composition of its two longitudinal strips 28AA and 28AB helps ensure that the foldable resilient member 20A is sufficiently strong and will not easily separate or be rent apart when forcibly folded during stowage. In general, however, for any anticipated antenna application, a balance must be struck between adding layers to the two longitudinal strips 28AA and 28AB and limiting the thicknesses of the two longitudinal strips 28AA and 28AB. The reason for such is that layers added to the multi-layer compositions of the two longitudinal strips 28AA and 28AB help make the foldable resilient member 20A strong but also tend to limit the range of elasticity of the foldable resilient member 20A.

Figure 6:
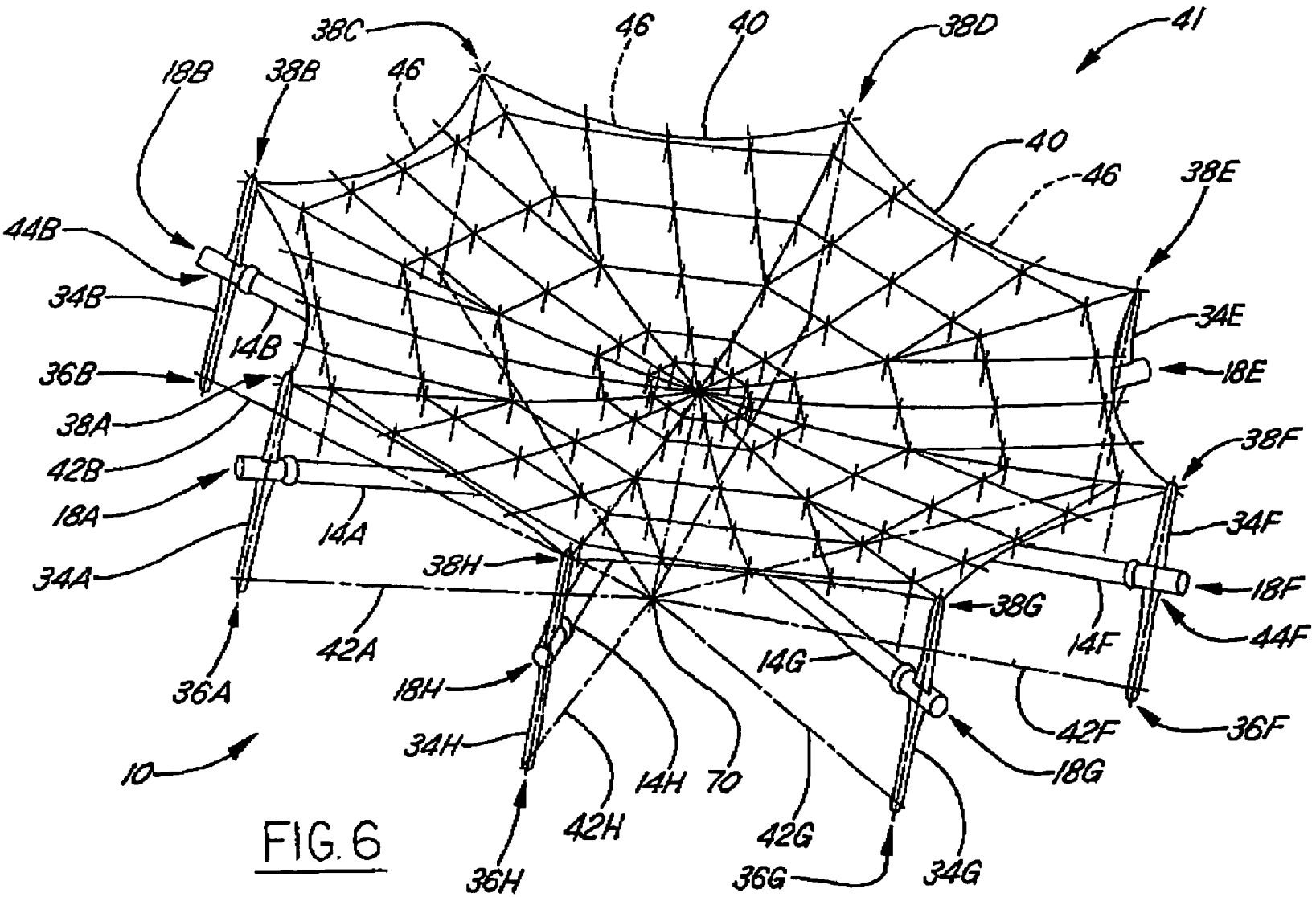
FIG. 6 is a perspective view of the framework in FIG. 3. In this view, the framework is shown to further include elongate outriggers, tensioning cables, radial catenary cables, circumferential catenary cables, tie-down cables, and a net for cooperatively suspending a reflective mesh between the load-bearing ends of the elongate outriggers which, in turn, are pivotally mounted on the distal ends of the elongate ribs. Also, in this view, the framework along with the reflective mesh are both fully deployed in a released position.

In FIG. 6, a perspective view of the framework 10 in a deployed and released position is illustrated therein. In this view, the framework 10 is shown to further include, first of all, a matching plurality of elongate outriggers 34 with one elongate outrigger 34 for each elongate rib 14. As illustrated, each elongate outrigger 34 has a tension-bearing end 36, a load-bearing end 38, and a middle section interconnecting both the load-bearing end 38 and the tension-bearing end 36 together. Each middle section of an elongate outrigger 34, in turn, is pivotally mounted on the distal end 18 of one of the elongate ribs 14 at a pivot point 44. Furthermore, although other constituent materials may be utilized, each elongate outrigger 34 is preferably made of the same material as both the elongate ribs 14 and the foldable resilient members 20, that being non-metallic fibers embedded within a resin matrix. As with both the elongate ribs 14 and the foldable resilient members 20, the non-metallic fibers preferably comprise carbon in its allotropic form of graphite, and the resin matrix preferably includes an epoxy, cyanate esther, or thermoplastic resin.

Along with the elongate outriggers 34, the framework 10 in FIG. 6 also further includes a matching plurality of tensioning cables 42 with one tensioning cable 42 for each elongate outrigger 34. Each of the tensioning cables 42 has one end attached to the tension-bearing end 36 of one of the elongate outriggers 34. The other ends of the tensioning cables 42 collectively pass through and are precisely tensioned via a point 70 closely associated with a spacecraft.

As variously illustrated in FIGS. 6 through 9, the framework 10 still further includes rib-aligned radial catenary cables 50, intermediate radial catenary cables 52, substantially radial catenary cables 54 and 56, substantially circumferential catenary cables 58, 62, 64, 66, and 68, tie-down cables 48, and a net 46. In general, the catenary cables and the tie-down cables serve to cooperatively suspend the net 46 between the load-bearing ends 38 of the elongate outriggers 34 whenever the elongate ribs 14 are in the released position and the tensioning cables 42 are sufficiently tensioned as in FIG. 6. When the net 46 is suspended in this manner, a mesh 40 both covering and attached to the net 46 is thereby suspended as well. The mesh 40 itself is made of a flexible material suited for reflecting electromagnetic waves within the radio frequency spectrum. Although other conventionally known constituent materials may be utilized, the mesh 40 is preferably made of a flexible material such as woven, gold-plated molybdenum wire. In essence, therefore, the mesh 40, together with the framework 10, serves and operates as a deployable mesh reflector type antenna 41.

Figure 7:
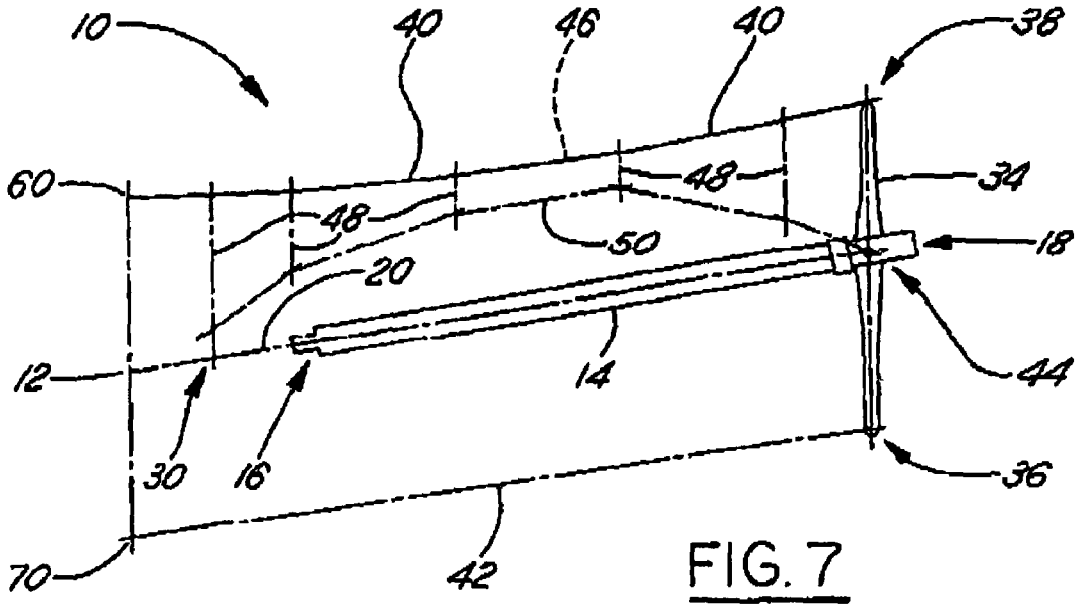
FIG. 7 is a side view of one elongate outrigger pivotally mounted on the distal end of one elongate rib as in FIG. 6. In this view, suspension of the net from the load-bearing end of the elongate outrigger in cooperation with a rib-aligned radial catenary cable, multiple tie-down cables, and a tensioning cable is particularly highlighted.

In FIG. 7, a side view of one elongate outrigger 34 that is pivotally mounted on the distal end 18 of one elongate rib 14 in a released position is illustrated. In this view, suspension of both the net 46 and the mesh 40 from the load-bearing end 38 of the elongate outrigger 34 in cooperation with a rib-aligned radial catenary cable 50, multiple tie-down cables 48, and a tensioning cable 42 is particularly highlighted. As illustrated, the rib-aligned radial catenary cable 50, first of all, is generally both suspended over and aligned with the elongate rib 14 while having one end tied to a point proximate the foldable resilient member 20 and its other end tied to a point proximate the pivot point 44. The multiple tie-down cables 48, in turn, are tied between the rib-aligned radial catenary cable 50 and the net 46. The mesh 40, last of all, is attached to the net 46 such that it substantially covers the entirety of the net 46 and so that the center 60 of the mesh 40 is both positioned directly above and collinearly aligned with both the hub 12 and the point 70. In general, when the elongate rib 14 is deployed into a released position as in FIGS. 6 and 7, the tensioning cable 42 applies a precise tension to the tension-bearing end 36 of the elongate outrigger 34. In doing so, the elongate outrigger 34 then pivots at pivot point 44 such that the load-bearing end 38 of the elongate outrigger 34 moves outward. As the load-bearing end 38 of the elongate outrigger 34 moves outward in this manner, the rib-aligned radial catenary cable 50, the tie-down cables 48, and the net 46 are all thereby tensioned such that the mesh 40 is spread out and stretched into its intended operable shape.

Figure 8:
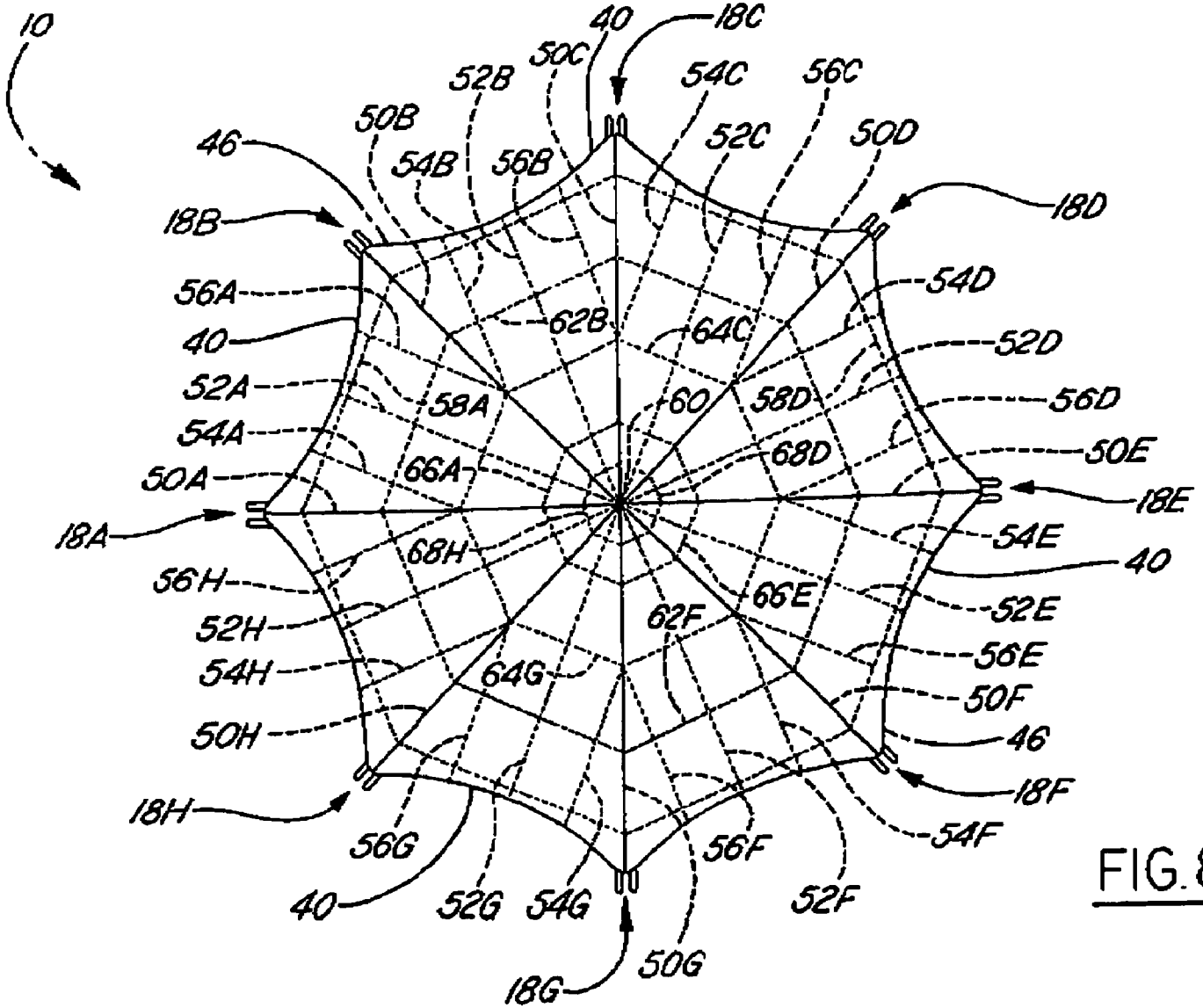
FIG. 8 is a plan view of the reflective mesh suspended between the load-bearing ends of the elongate outriggers that, in turn, are pivotally mounted on the distal ends of the elongate ribs as in FIG. 6. In this illustration, a top view of the arrangement of radial catenary cables and circumferential catenary cables collectively situated underneath the mesh is particularly highlighted.

In FIG. 8, a plan view of the mesh 40 suspended between the load-bearing ends 38 of the elongate outriggers 34 which, in turn, are pivotally mounted on the distal ends 18 of the elongate ribs 14 is illustrated. In the illustration, a top view of the arrangement of rib-aligned radial catenary cables 50, intermediate radial catenary cables 52, substantially radial catenary cables 54 and 56, and substantially circumferential catenary cables 58, 62, 64, 66, and 68 collectively situated underneath the mesh 40 is particularly highlighted. As illustrated, the rib-aligned radial catenary cables 50, first of all, generally radiate from the hub 12, situated underneath the center 60 of the mesh 40, in line with the elongate ribs 14. The intermediate radial catenary cables 52, in turn, generally radiate from the hub 12, situated underneath the center 60 of the mesh 40, in between consecutive pairs of elongate ribs 14. The substantially circumferential catenary cables 58, 62, 64, 66, and 68, last of all, are generally perpendicular to the intermediate radial catenary cables 52 and are generally both tied and tensioned between consecutive pairs of rib-aligned radial catenary cables 50.

Figure 9:
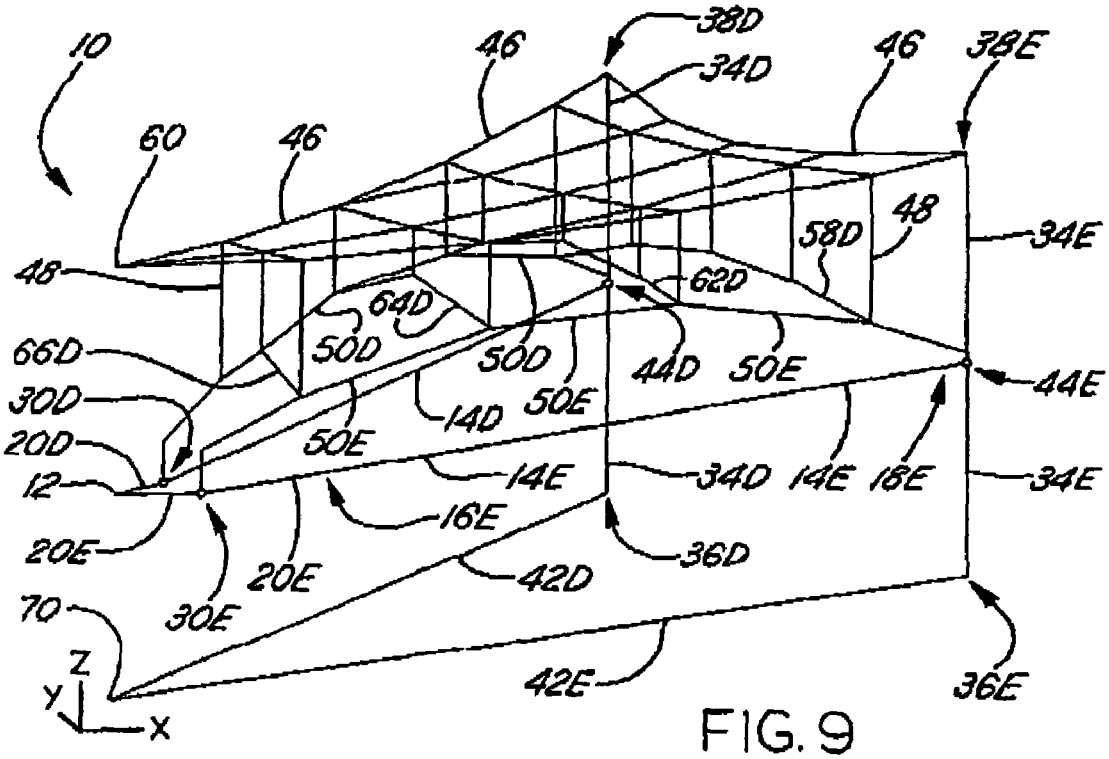
FIG. 9 is an illustration of a finite element model of the framework in FIG. 6 taken in part between two elongate ribs. In this illustration, the model is set forth within a three-dimensional Cartesian coordinate system.

In FIG. 9, a finite element model of the framework 10, deployed into a released position as in FIG. 6 and taken in part between elongate ribs 14D and 14E, is illustrated. In this illustration, the model is set forth within a three-dimensional x, y, and z Cartesian coordinate system for analysis of various torques existing within the framework 10 during deployment. To date, experimentation and analysis of proposed frameworks for both 2-meter diameter and 4-meter diameter deployable mesh reflector type antennas have successfully demonstrated and confirmed that a framework 10 for a deployable antenna of up to at least 6 meters in diameter pursuant to the present invention will indeed operate as expected.

In sum, therefore, a framework with foldable resilient members for a deployable mesh reflector antenna pursuant to the present invention successfully renders unnecessary many conventional uses of electro-mechanical motors or actuators in conjunction with pulleys, cables, hinges, and/or sliding joints for deploying various antennas. Such obviation is highly desirable, for electromechanical motors or actuators in conjunction with such pulleys, cables, hinges, and/or sliding joints can be excessively heavy, functionally complex, expensive, and susceptible to reliability problems.

Furthermore, the utilization of foldable resilient members (i.e., HSESDs) within a framework pursuant to the present invention also serves to generate a significantly large strain force for successfully deploying the elongate ribs. Such a large deployment force advantageously allows for the incorporation of intermediate radial catenary cables within the framework for additional support and antenna precision. In addition, such a large deployment force also advantageously allows for the use of very high net and mesh tensions. In sum, both of these advantages help significantly increase surface precision in the mesh reflector antenna and therefore facilitate better overall antenna performance.

Moreover, by rendering unnecessary and eliminating numerous metallic fittings, hinges, or sliding joints through the use of foldable resilient members, a mesh reflector antenna pursuant to the present invention is generally superior to many conventional mesh reflector antennas in terms of repeatability in the precision positioning of its mesh over successive deployments. In particular, the manufacture and performance tolerances conventionally permitted within various metallic fittings, hinges, and sliding joints are, at least to some degree, cumulative when such metallic contrivances are incorporated together within the same antenna. Consequently, repeatability in the precision positioning of a mesh associated with such a conventional antenna is sometimes adversely affected over successive deployments, especially when operating under conditions involving extreme temperatures. In contrast, a mesh reflector antenna with foldable resilient members pursuant to the present invention is less susceptible to problems associated with repeatability in the precision positioning of its mesh, for the mesh reflector antenna pursuant to the present invention inherently has fewer metallic fittings, hinges, and sliding joints with tolerances that may adversely affect such precision positioning.

Lastly, by eliminating unnecessary metallic fittings and also minimizing the coefficients of thermal expansion (CTEs) associated with both the elongate ribs and the foldable resilient members, a rib-supported mesh reflector antenna pursuant to the present invention is not as susceptible to thermal distortion as are other conventionally known rib-supported reflector antennas. Furthermore, by balancing the CTE associated with the constituent materials of both the catenary cables and the net with the CTE associated with the constituent material(s) of the tensioning cables, a rib-supported mesh reflector antenna pursuant to the present invention is even further less susceptible to thermal distortion as compared to other conventionally known rib-supported reflector antennas. As an ultimate result, the overall precision of a framework and associated mesh reflector antenna according to the present invention is significantly high as compared to other conventionally known rib-supported reflector antennas.

While the present invention has been described in what is presently considered to be its most practical and preferred embodiment or implementation, it is to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A framework for a deployable antenna, said framework comprising:

a hub;

a plurality of elongate ribs each having a proximal end and a distal end; and a matching plurality of foldable resilient members interconnecting the proximal ends of said elongate ribs to said hub;

wherein at least one of said hub, said elongate ribs, and said foldable resilient members comprises non-metallic fibers embedded within a resin matrix; said non-metallic fibers comprise carbon in its allotropic form of graphite; and said resin matrix includes at least one type of resin selected from the group consisting of an epoxy resin, a cyanate esther resin, and a thermoplastic resin.

2. A framework according to claim 1, wherein said deployable antenna is a mesh reflector type antenna.

3. A framework according to claim 1, wherein said hub comprises metal.

4. A framework according to claim 1, wherein said hub is structurally adapted for being mounted on at least one space travel vehicle selected from the group consisting of an orbiter, a satellite, a spacecraft, a space probe, a spaceship, a space shuttle, and a space station.

5. A framework for a deployable antenna, said framework comprising:

a hub;

a plurality of elongate ribs each having a proximal end and a distal end; and a matching plurality of foldable resilient members interconnecting the proximal ends of said elongate ribs to said hub;

wherein said hub comprises non-metallic fibers embedded within a resin matrix; said non-metallic fibers comprise carbon in its allotropic form of graphite; and said resin matrix includes a type of resin selected from the group consisting of an epoxy resin, a cyanate esther resin, and a thermoplastic resin.

6. A framework according to claim 5, wherein said hub is structurally adapted for being mounted on a space travel vehicle selected from the group consisting of an orbiter, a satellite, a spacecraft, a space probe, a spaceship, a space shuttle, and a space station.

7. A framework for a deployable antenna, said framework comprising:

a hub;

a plurality elongate ribs each having proximal end and a distal end; and a matching plurality of foldable resilient members interconnecting the proximal ends of said elongate ribs to said hub;

wherein each of said elongate ribs comprises non-metallic fibers embedded within a resin matrix; said non-metallic fibers comprise carbon in its allotropic form of graphite; and said resin matrix includes a type of resin selected from the group consisting of an epoxy resin, a cyanate esther resin, and a thermoplastic resin.

8. A framework for a deployable antenna, said framework comprising:

a hub;

a plurality of elogate ribs each having a proximal end and a distal end; and a matching plurality of foldable resilient members interconnecting the proximal ends of said elongate ribs to said hub;

wherein each of said foldable resilient members comprises non-metallic fibers embedded within a resin matrix; said non-metallic fibers comprise carbon in its allotropic form of graphite; and said resin matrix includes a type of resin selected from the group consisting of an epoxy resin, a cyanate esther resin, and a thermoplastic resin.

9. A framework according to claim 8, wherein each of said foldable resilient members has a shape substantially resembling a hollow tube segment.

10. A framework according to claim 9, wherein said hollow tube segment has a cylindrical wall including at least one elongated slot defined therethrough.

11. A framework for a deployable antenna, said framework comprising;

a hub;

a plurality of elongate ribs each having a proximal end and a distal end;

a matching plurality of foldable resilient members interconnecting the proximal ends of said elongate ribs to said hub, wherein each of said foldable resilient members is capable of storing strain energy whenever forcibly folded and also releasing said strain energy whenever subsequently permitted to elastically unfold;

a matching plurality of elongate outriggers each having a tension-bearing end, a load-bearing end, and a middle section interconnecting said load-bearing end to said tension-bearing end, wherein the middle sections of said elongate outriggers are pivotally mounted on the distal ends of said elongate ribs; and a removable restraint for collectively holding said elongate ribs in a captured position wherein said foldable resilient members are forcibly folded such that said distal ends of said elongate ribs are thereby proximately situated together;

wherein said strain energy drives automatic deployment of said deployable antenna, whenever said removable restraint is removed from said elongate ribs, by forcibly unfolding said foldable resilient members in an elastic manner such that said elongate ribs are thereby splayed apart in a released position.

12. A framework according to claim 11, wherein each of said elongate outriggers comprises non-metallic fibers embedded within a resin matrix.

13. A framework according to claim 12, wherein said non-metallic fibers comprise carbon in its allotropic form of graphite, and said resin matrix includes a type of resin selected from the group consisting of an epoxy resin, a cyanate esther resin, and a thermoplastic resin.

14. A framework according to claim 11, said framework further comprising a matching plurality of tensioning cables attached to the tension-bearing ends of said elongate outriggers.

15. A framework according to claim 14, said framework further comprising radial catenary cables, substantially circumferential catenary cables, tie-down cables, and a net;

wherein said radial catenary cables, said substantially circumferential catenary cables, and said tie-down cables cooperatively suspend said net between the load-bearing ends of said elongate outriggers whenever said elongate ribs are in said released position and said tensioning cables are sufficiently tensioned.

16. A framework for a deoloyable antenna, said framework comprising:

a hub;

a plurality at elongate ribs each having a proximal end and a distal end; and a matching plurality of foldable resilient members interconnecting the proximal ends of said elongate ribs to said hub;

wherein said deployable antenna includes a mesh attachable to a net and comprising a flexible material suited for reflecting electromagnetic waves within the radio frequency spectrum; and said flexible material comprises woven, gold-plated molybdenum wire.

17. A framework for a deployable antenna, said framework comprising:

a hub;

a plurality of elongate ribs each having a proximal end and a distal end; and a matching plurality of foldable resilient members interconnecting the proximal ends of said elongate ribs to said hub;

wherein each of said foldable resilient members comprises non-metallic fibers embedded within a resin matrix; said non-metallic fibers comprise carbon in its allotropic form of graphite; and said resin matrix includes a type of resin selected from the group consisting of an epoxy resin, a cyanate esther resin, and a thermoplastic resin; and wherein each of said foldable resilient members is capable of storing strain energy whenever forcibly folded and also releasing said strain energy whenever subsequently permitted to elastically unfold.

18. A deployable antenna comprising:

a framework including a hub, a plurality of elongate ribs each having a proximal end and a distal end and a matching plurarity of foldable resilient members interconnecting the proximal ends of said elongate ribs to said hub; and a mesh suspended from the distal ends of said elongate ribs;

wherein said mesh comprises a flexible material suited for reflecting electromagnetic waves within the radio frequency spectrum; and said flexible material comprises woven, gold-plated molybdenum wire.

19. A satellite comprising:

a body; and a deployable antenna mounted on said body and including a framework and a mesh;

wherein said framework includes a hub, a plurality of elongate ribs each having a proximal end and a distal end, and a matching plurality of foldable resilient members interconnecting the proximal ends of said elongate ribs to said hub;

wherein said mesh is suspended from the distal ends of said elongate ribs; said mesh comprises a flexibie material suited for reflecting electromagnetic waves within the radio frequency spectrum; and said flexible material comprises woven, gold-plated molybdenum wire.

20. A method for stowing and deploying a rib-supported mesh reflector antenna, said method comprising the steps of:

obtaining a hub, a plurality of elongate ribs each having a proximal end and a distal end, and a matching plurality of foldable resilient members; wherein at least one of said hub, said elongate ribs, and said foldable resilient members comprises non-metallic fibers embedded within a resin matrix; said non-metallic fibers comprise carbon in its allotropic form of graphite; and said resin matrix includes at least one type of resin selected from the group consisting of an epoxy resin, a cyanate esther resin, and a thermoplastic resin;

interconnecting the proximal ends of said plurality of elongate ribs to said hub with said matching plurality of foldable resilient members;

suspending a commonly held reflective mesh from the distal ends of said elongate ribs;

applying a removable restraint to said elongate ribs to thereby hold and stow said elongate ribs in a captured position wherein said foldable resilient members are forcibly folded such that said distal ends of said elongate ribs are proximately situated together; and removing said restraint from said elongate ribs so that strain energy, stored within said foldable resilient members when forcibly folded, forcibly unfolds said foldable resilient members in an elastic manner such that said elongate ribs are thereby splayed apart in a released position and said reflective mesh is automatically deployed.

* * * * *